United States Patent [19]

Jung

[11] Patent Number: 4,557,051

[45] Date of Patent: Dec. 10, 1985

[54] MANUALLY GUIDED POWER ASSISTED CUTTING MACHINE

[75] Inventor: Rolf Jung, Waiblingen, Fed. Rep. of Germany

[73] Assignee: Krauss u. Reichert GmbH & Co. KG, Fellbach, Fed. Rep. of Germany

[21] Appl. No.: 545,902

[22] PCT Filed: Mar. 10, 1983

[86] PCT No.: PCT/DE83/00043

§ 371 Date: Oct. 27, 1983

§ 102(e) Date: Oct. 27, 1983

[87] PCT Pub. No.: WO83/03219

PCT Pub. Date: Sep. 29, 1983

[30] Foreign Application Priority Data

Mar. 11, 1982 [DE] Fed. Rep. of Germany ..... 3208746

[51] Int. Cl.[4] ..... B26D 5/10; A41H 43/00

[52] U.S. Cl. ..... 30/273; 83/71; 83/925 CC

[58] Field of Search ..... 83/72, 171, 71, 925 CC, 83/747; 30/124, 273, 275

[56] References Cited

U.S. PATENT DOCUMENTS

| | | | |
|---|---|---|---|
| 2,742,964 | 4/1956 | Levin | 30/273 |
| 2,877,550 | 7/1958 | Scuderi | 30/228 |
| 3,618,687 | 7/1969 | Ripple et al. | 180/19 H |
| 3,780,607 | 12/1973 | Gerber | 83/925 CC |
| 3,803,960 | 4/1974 | Pearl | 83/925 CC |
| 3,991,636 | 11/1976 | Devillers | 83/71 |
| 4,092,777 | 6/1978 | Jung | 30/273 |
| 4,107,839 | 8/1978 | Jung | 30/273 |
| 4,403,416 | 9/1983 | Adachi | 30/273 |

*Primary Examiner*—Jimmy C. Peters

*Attorney, Agent, or Firm*—Leydig, Voit & Mayer, Ltd.

[57] ABSTRACT

The invention relates to a cutting machine, in particular a fabric cutting machine, comprising a bearing table for the material and a supporting structure, which is displaceable along the table, for a cutting tool rotatable about a vertical axis and comprising drive means for driving the cutting tool relative to the table. In the case of a cutting machine of this type the invention has a first angular position detector associated with the cutting tool, this first angular position detector generating signals corresponding to the angular position of the cutting tool. In addition, a guide handle is provided on the cutting tool, this handle having associated signal generating means for producing additional control signals such that, on the basis of the signals from the first angular position detector and the additional signal generating means, control signals may be generated for the drive means of the cutting tool, which enable the cutting procedure to be servo-assisted when the cutting tool is guided by hand.

15 Claims, 11 Drawing Figures

Figure 1:
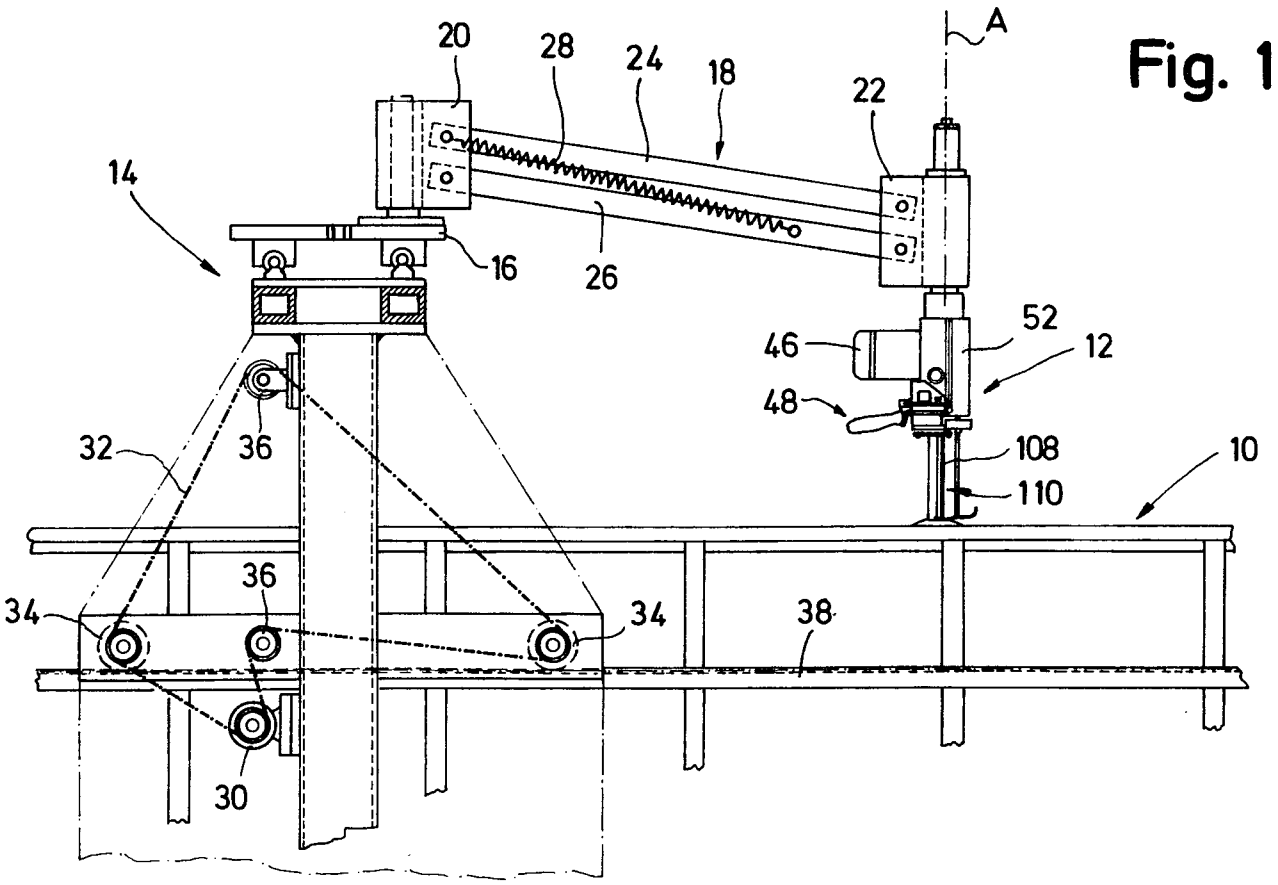

A
22
18
24
28
20
16
14
52
12
46
48
108
110
10
38
26
34
36
32
30

MANUALLY GUIDED POWER ASSISTED CUTTING MACHINE

The invention relates to a machine for cutting out flat material, in particular a fabric cutting machine, comprising a table for bearing the flat material, a supporting structure movable along the bearing table and supporting a cutting tool, in particular a cutter blade mechanism, rotatable about an axis extending perpendicular to the bearing surface of the table, and having an associated cutting tool drive, and comprising drive means consisting of a longitudinal drive for displacing the supporting structure along the table as well as at least one additional, controllable drive associated with the supporting structure for controlling movement of the cutting tool relative to the bearing surface of the table in a direction of cutting predetermined by the orientation of a cutting edge of the cutting tool.

The invention deals in particular with a cutting machine comprising a bridge displaceable by the longitudinal drive and spanning the bearing table in a transverse direction and also comprising a cross slide which is mounted on the bridge, displaceable relative to the bridge by a cross drive and supports the cutting tool, the bridge normally being supported at both ends relative to the cutting table but can, if necessary, be supported only on one side in order to span the cutting table in the form of a supporting arm.

A cutting machine of this type is known, for example, from CH-PS No. 406 103 and operates as an automatic cutting machine, with which the data for the sample to be cut out are either stored beforehand or obtained during operation by scanning a paper pattern, which can, if necessary, be placed directly beneath the material web and will be scanned by suitable scanning elements which detect the line of the paper pattern to be followed at a point slightly in front of the cutting edge.

Apart from these automatic machines, manually operated cutting machines are also known, with which the cutting tool is suspended from a support means which is displaceable by means of a frame or a bridge in the longitudinal direction of the cutting table. For example, German Utility Model G No. 81 08 075.1 describes a cutting machine, with which the cutting tool is suspended from a supporting arm held in a rotatable mounting for sliding displacement, the mounting itself being secured to a spider-like carriage with three supports, which may be moved by hand along the cutting table. Furthermore, DE-OS No. 27 03 066 describes a cutting machine, in particular a material cutting machine, comprising a carriage displaceable in the longitudinal direction of the bearing table, a beam being pivoted on this carriage and having at least two arms which are interconnected by a joint having a vertical joint axis, the cutting device being mounted at the free end of the outer arm such that it is rotatable about a vertical axis.

A disadvantage of the known cutting machines, with which the cutting device, in particular a cutter blade, is moved by hand through the material to be cut, is the fact that considerable force is required on the part of the operating personnel and at least some parts of the support means must also be moved by the operating personnel—in individual cases a motor-operated longitudinal drive is provided so that the support means can follow the cutter blade section by section by actuating the drive means. This leads, on the one hand, to the operating personnel becoming tired rather quickly and, on the other hand, to inaccurate cutting since the force required will naturally impair the sensitivity of movement necessary to guide the cutting tool.

Proceeding on the basis of this prior art the object underlying the invention is to improve a cutting machine of the type described at the beginning such that the work of the operating personnel is made easier and greater cutting accuracy is achieved.

This object is accomplished according to the invention in that a first angular position detector is associated with the cutting tool, that with the aid of said first angular position detector directional control signals corresponding to the angular position of the cutting tool relative to its axis of rotation are generated, that a guide handle is provided on the cutting tool for rotating the cutting tool by hand into the desired angular position relative to its axis of rotation, that signal generating means are associated with the guide handle, with which at least one control signal is generated when the handle is acted upon and this control signal serves as a start signal for the drive means and that a control is provided, with which drive control signals are generated for the drive means to drive the cutting tool in the direction of cutting as a function of the directional control signals from the first angular position detector and at least one control signal from the signal generating means associated with the guide handle.

The decisive advantage of the inventive cutting machine is the fact that the operating personnel merely needs to move the cutting tool into the correct angular position and to signal by operating the handle, for example by actuating a switch on the guide handle or by touching a sensor on the housing of the cutting tool which can be reached with the thumb when the handle is gripped, that cutting is to take place in the direction of the cutting edge, i.e. in the cutting direction, whereupon the cutting tool will be moved forward by suitable, motor-operated drive means in the desired direction without the operating personnel having to exert the force otherwise necessary for this. The operating personnel can therefore concentrate fully on following exactly the suitably predetermined lines of the pattern.

A particularly simple possibility of motor-operated driving of the cutting tool in the desired direction results when the cutting tool is secured in particular by a supporting arm to a slide which is displaceable along a bridge spanning the cutting table. In this case the signals generated by a first angular position detector concerning the angular position of the cutting tool relative to its vertical axis of rotation can be converted relatively easily into corresponding X/Y coordinate signals for the control of the traction motors. A motor-operated drive of the cutting tool may also be realised without difficulty in the case of support means for the cutting tool having a different construction when, for example, corresponding position detectors are provided for the joints of the beam in the cutting machine according to DE-OS No. 27 03 066 and corresponding drive motors are provided to pivot the arms of the beam towards each other and relative to the carriage displaceable in the longitudinal direction of the cutting table. Corresponding solutions are known, for example, for the grab arms of industrial robots so that it is unnecessary to go into greater detail within the scope of the present application.

It has proven favourable to be able to feed in additional information via the guide handle concerning the desired direction of travel so that a motor-operated drive is possible not only in the cutting direction but also in the opposite direction—return movement. This is often desirable during cutting when, for example, a cut is first made beyond the pattern line whereupon the tool is then moved back a certain distance and set again at a suitable angular position to continue cutting. In an advantageous development of the invention this possibility can be realised in that a guide handle projecting radially away from the cutting tool housing or one designed in the shape of a control stick and oriented more or less perpendicularly is pressed forwards or inwards towards the cutting tool when a cut is desired in the cutting direction whereas it is pulled backwards or outwards away from the tool when a reverse movement is desired. The adjustments or displacements of the guide handle or a movable grip element of it relative to its zero position can be converted into corresponding control signals in various ways, for example by means of limit switches.

It is, however, particularly advantageous in development of the invention when the movements of a grip element of the guide handle are converted into positioning movements of a rotary or sliding potentiometer or into rotary movement of a position detector in order to obtain control signals which not only indicate whether a cutting movement or a reverse movement is required but also convey information concerning the desired speed at which the cutting tool is to be displaced. In the case of a preferred embodiment of the invention this is achieved in that the output signal from the second angular position detector, which, in its amplitude and phase relative to the supply voltage for the second angular position detector, corresponds to the deflective movement of the grip element, is used as an input signal for the X/Y position detector. The output signals from the latter are compared with a reference voltage having a predetermined phase to obtain nominal value signals for the drive movements in the X direction and Y direction.

The guide handle can, irrespective of whether it is designed as a radial grip or as a type of control stick, have a zero position designed as a stop position and be freely pivoted or moved to both sides. It is, however, favourable for spring means to be provided, which resiliently bias the guide handle or a movable grip element of it into the zero position and generate an elastic force in the direction of the zero position corresponding to the extend of displacement. The force to be exerted by the operating personnel must therefore correspond to the desired speed for moving the cutting tool, the correlation between the extent of displacement or rather the force applied, on the one hand, and the speed, on the other, for movement in the cutting direction is thereby preferably the same as for reverse movement although, in principle, it is also possible for the reverse movement to be faster than movement in the cutting direction.

Figure 2:
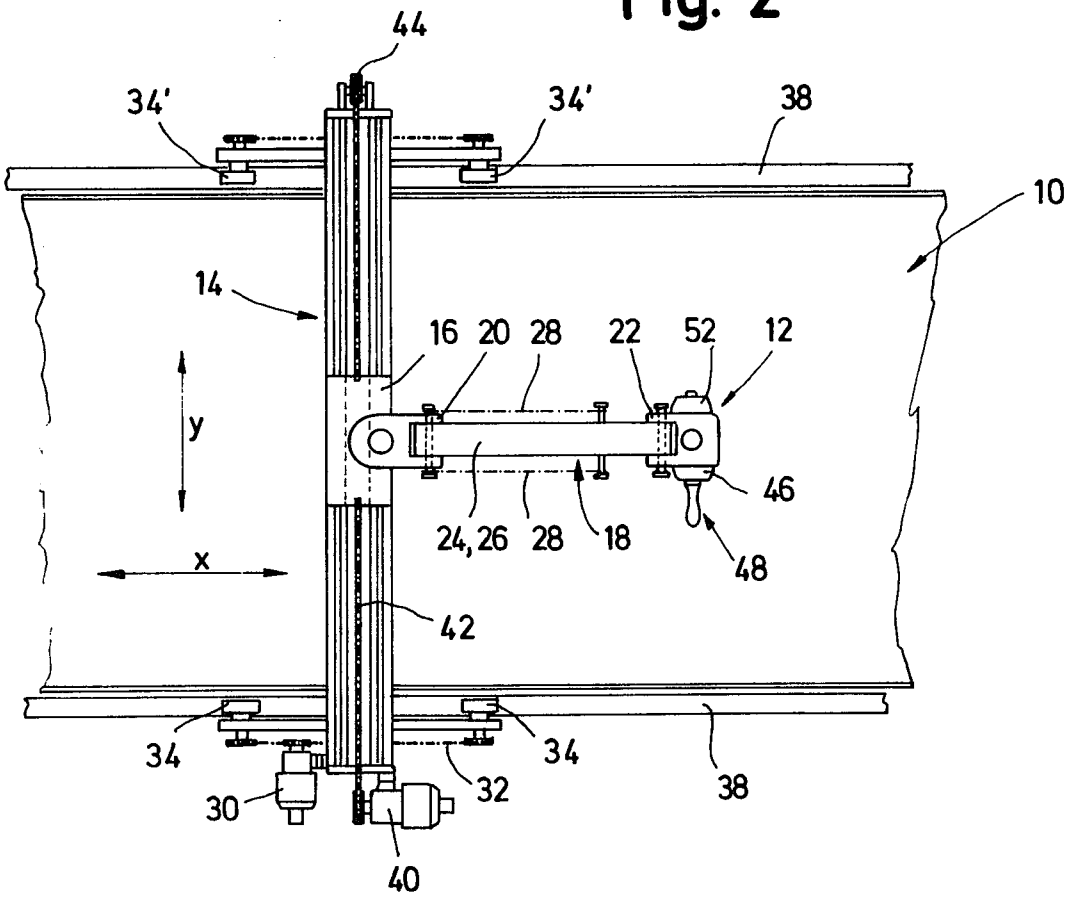
Figure 3:
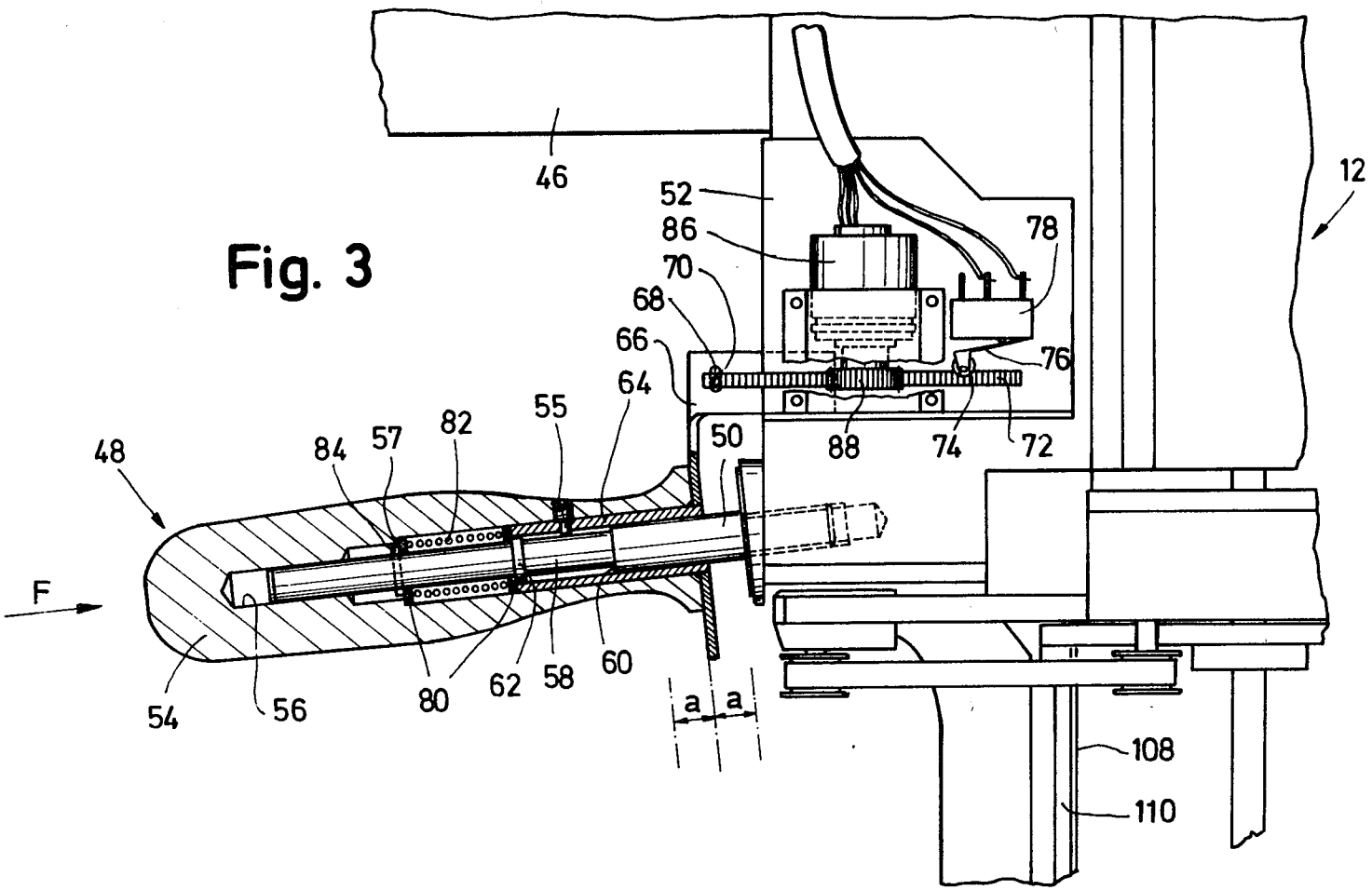
Figure 4:
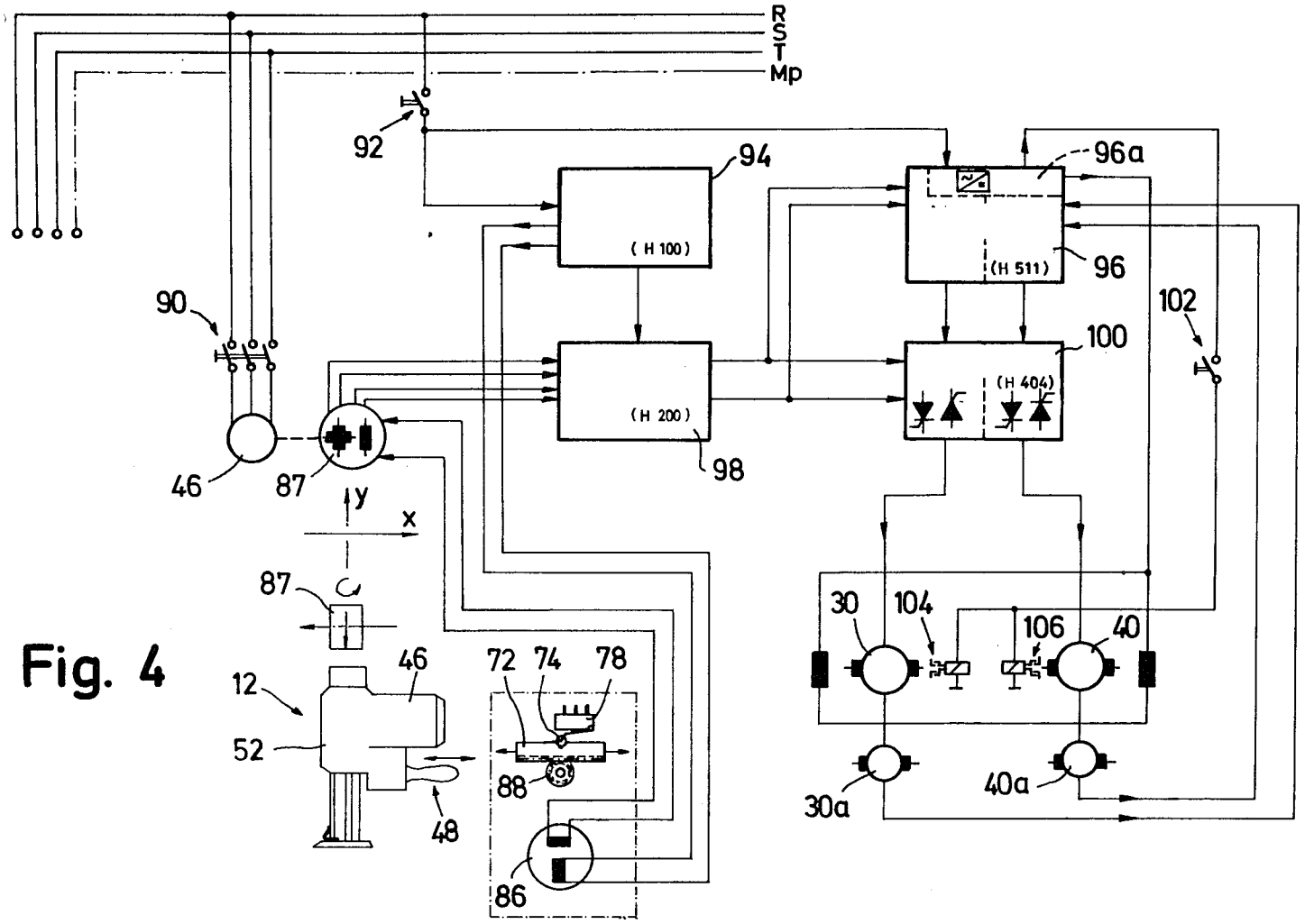
Figure 5:
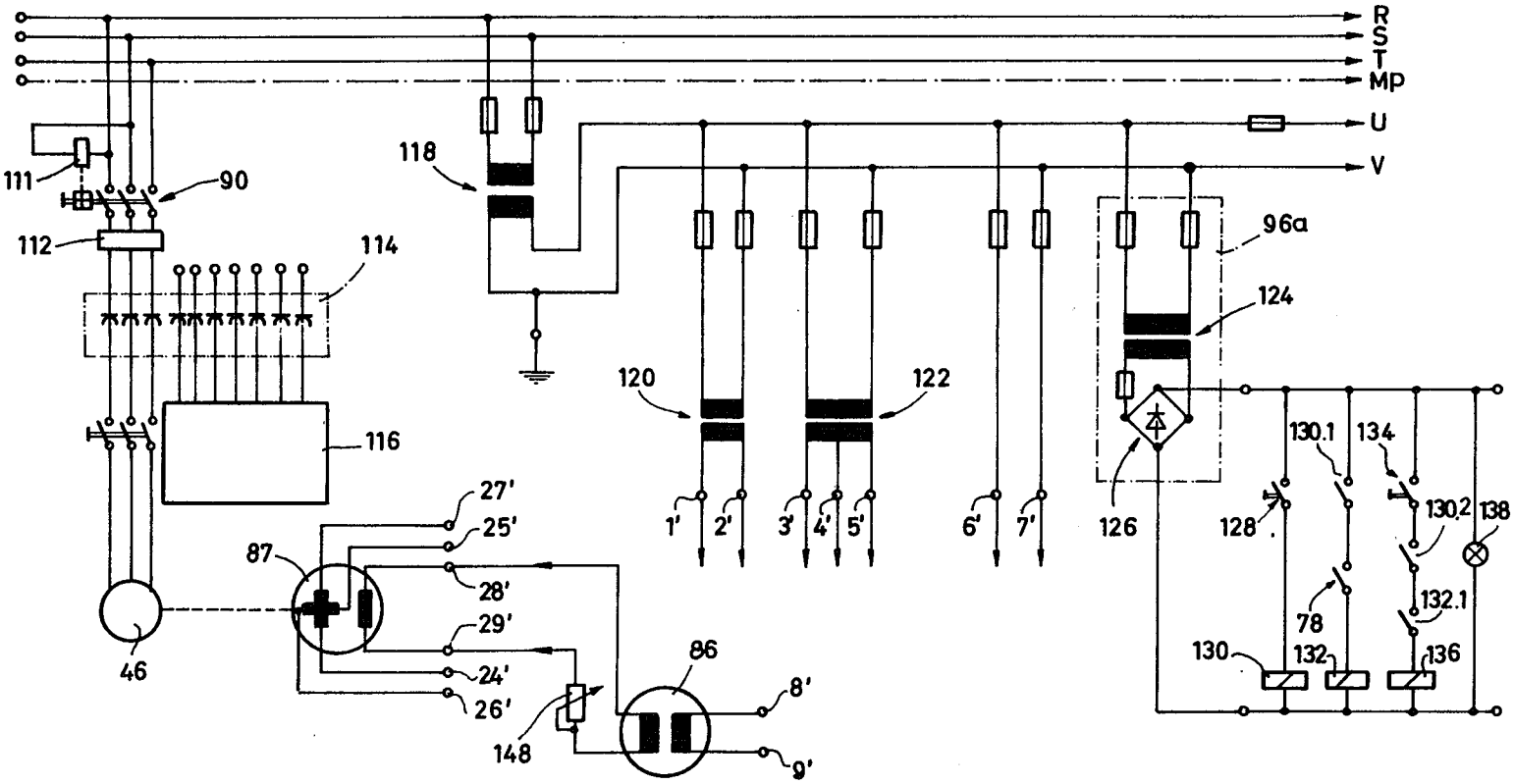
Figure 6:
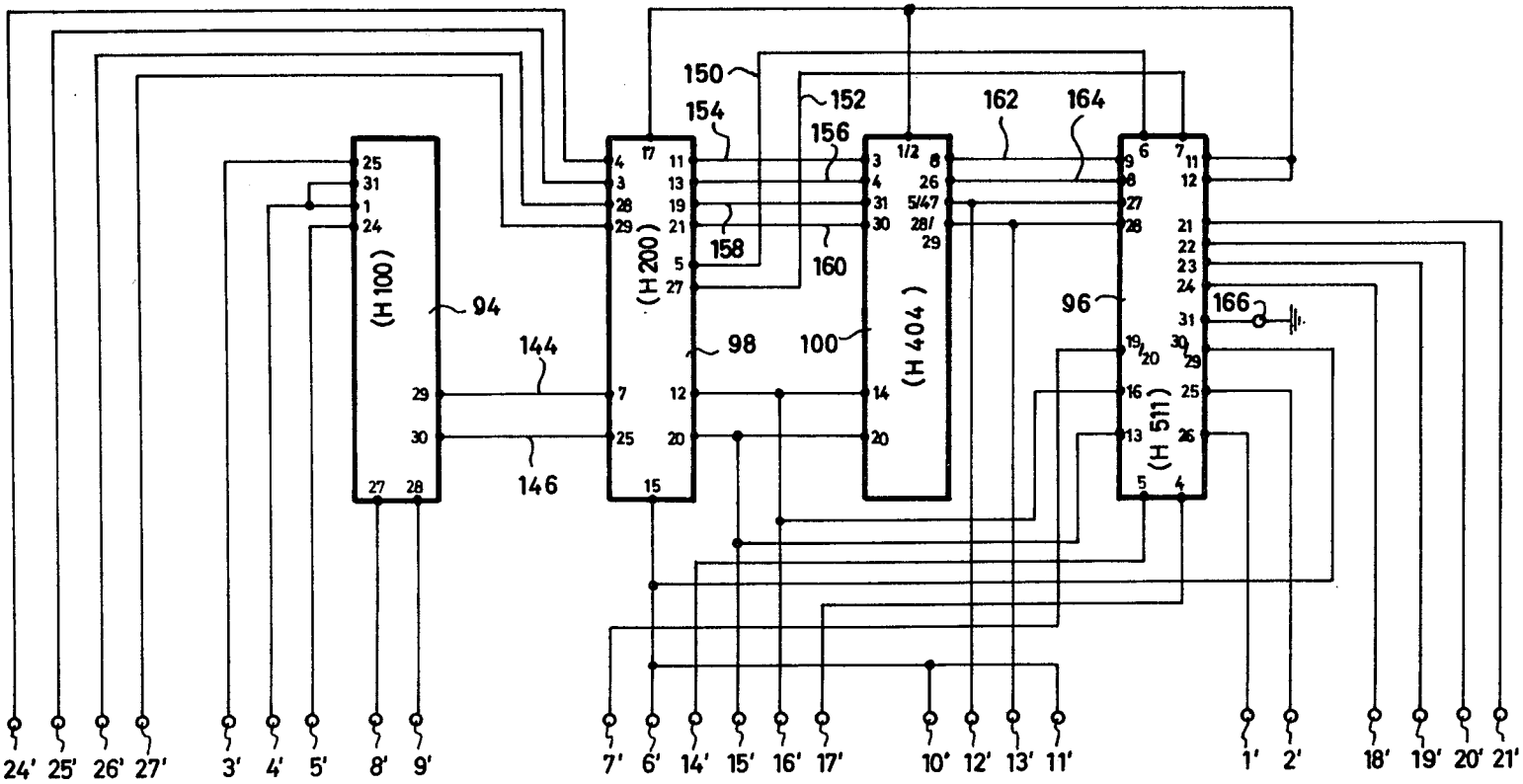
Figure 7:
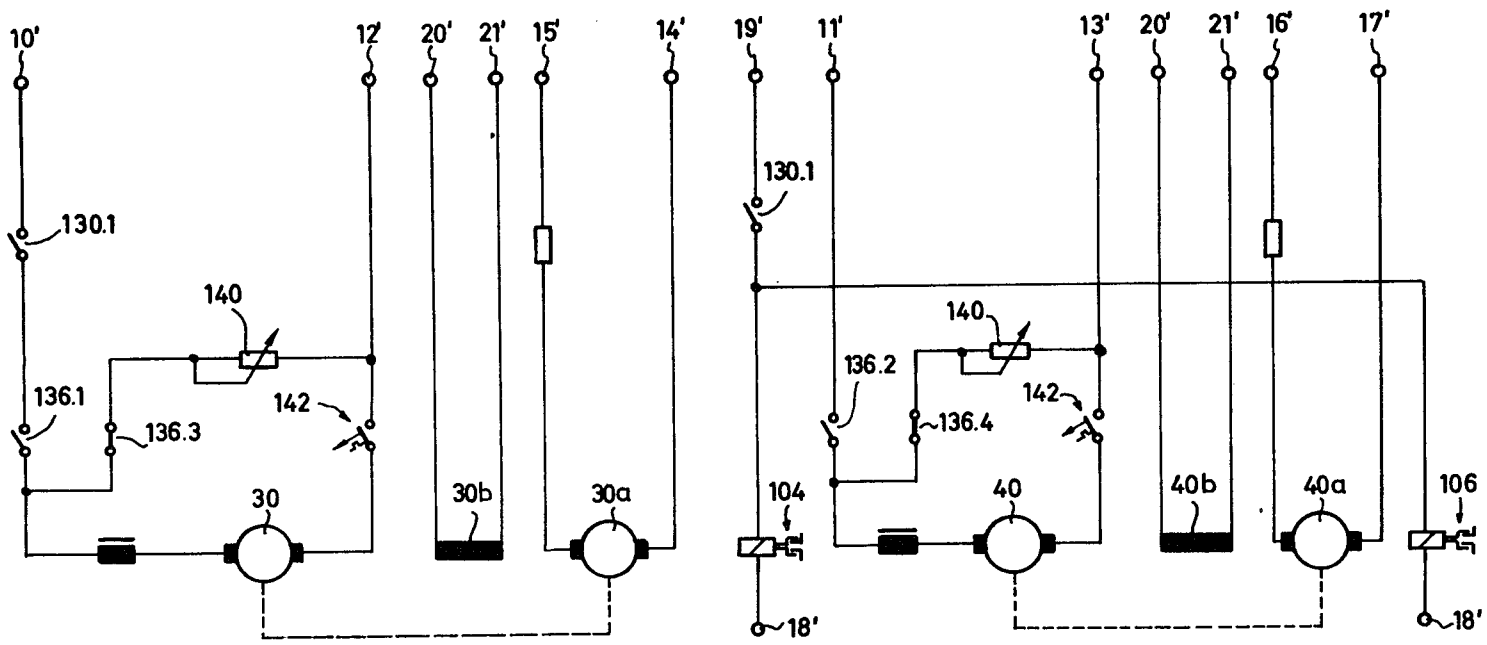

Additional details and advantages of the invention are explained in detail in the following on the basis of drawings and/or are the subject matter of subclaims. The drawings show:

FIG. 1 a side view of a preferred embodiment of an inventive cutting machine;

FIG. 2 a plan view of the cutting machine according to FIG. 1;

FIG. 3 details of the guide handle and the associated signal generating means for a cutting machine according to FIGS. 1 and 2;

FIG. 4 a schematic block diagram of a preferred embodiment of a control for the cutting machine according to FIGS. 1 to 3;

FIGS. 5 to 7 diagrams showing details of the electric machine control according to FIG. 4 and FIGS. 8 to 11 four additional embodiments of guide handles usable as control elements within the scope of the invention, in representations corresponding to FIG. 3.

The cutting machine according to FIGS. 1 and 2 shows in detail a bearing table 10, on which the flat material is to be spread and cut out according to a predetermined pattern which is normally laid in the form of a tracing on top of the upper layer of material. The flat material to be cut out is preferably fabric or fabric webs, which are spread in several superposed layers on the table 10 by means of a spreading machine of known construction so that a plurality of identical cuts are obtained simultaneously from each cutting procedure.

The cutting of the flat material is carried out in the cutting machine shown by means of a cutting tool, in particular a cutter blade mechanism 12, which is mounted on a supporting structure and rotatable or pivotable about an axis of rotation A coincidental with the cutting edge. The axis of rotation A extends perpendicular to the bearing surface of the table which is, generally, at least substantially horizontal.

The supporting structure has, in the case of the embodiment of the cutting machine under consideration, a bridge 14 which spans the table 10 in a transverse direction, i.e. across its entire width, and which is displaceable in the longitudinal direction of the table 10. The longitudinal direction is also designated in this application as the X direction and the cross direction is also designated as the Y direction.

The supporting structure also has a cross slide 16 which is displaceable in the Y direction, i.e. across the table 10 and therefore along the bridge 14. In addition, the supporting structure has a cantilever 18 which has at one end a mounting 20 fixed to the cross slide 16 and the other end of which has a mounting 22, to which the cutter blade mechanism 12 is secured. Two parallel beams 24, 26 are provided between the two mountings 20 and 22 and are pivotally connected to them. An inclined tension spring 28 is associated with these beams; the ends of the spring engage on the mountings 20 and 22 and the spring itself generates, relative to the free end of the cantilever 18, a certain, upwardly directed initial biasing, which counteracts the force of the weight of the cutter blade mechanism 12.

As shown in FIGS. 1 and 2 the bridge 14 is driven by a longitudinal motor 30 mounted on the bridge, this motor driving two gear wheels 34 via a chain 32 or also via a toothed belt or the like. The chain 32 is guided in addition over deflector rollers 36, of which at least one should be designed as a tension roller. The gear wheels 34 mesh with a toothed rail 38 which extends along the longitudinal side of the table 10 facing the onlooker in FIG. 1. A corresponding toothed rail 38 can also be provided on the opposite longitudinal side of the table 10. Gear wheels 34' corresponding to the gear wheels 34 interact with this toothed rail, these gear wheels 34' again being, if necessary, interconnected via and driven by a chain. The chain can be driven via a cross shaft connected with one of the deflecting rollers 36.

The cross slide 16 is driven by a cross motor 40, which is mounted on the bridge 14, via a chain 42 which is fixed to the cross slide 16 and runs over chain wheels 44 permanently mounted on the bridge.

The cutter blade mechanism 12 is driven via a cutting tool drive in the form of a cutter blade motor 46, which is screwed directly onto the housing 53 of the cutter blade mechanism 12. The cutter blade motor 46 is supplied with current in the customary way via a slip-ring arrangement in the interior of the mounting 22 and via flexible feed lines, as described for example in DE-OS No. 27 03 066.

The construction of the cutting machine under consideration is, insofar as it has been described above, to a large extent similar to the construction of known cutting machines with longitudinal and cross slides, although it should be noted that these known cutting machines are designed as fully automatic machines, with which the longitudinal motor, the cross motor and the cutter blade motor are controlled as a function of simultaneously sensed or programmed data corresponding to the pattern of a sample to be cut out.

Unlike the prior art, the inventive cutting machine operates as a cutting machine actuated by hand and being servo-assisted. To this end the cutter blade mechanism 12 is developed in a special way which will be explained in more detail on the basis of FIG. 3. A special control is also provided and this will also be explained in detail.

FIG. 3 is a detailed representation of the cutter blade mechanism 12 showing that a guide handle 48 projecting radially from the housing 52 of the cutter blade mechanism 12 is provided beneath the cutter blade motor 46. The guide handle 48 has a rod-like holder 50, the inner end of which—to the right in FIG. 3—is screwed to the housing 52 of the cutter blade mechanism. An axially displaceable grip element 54 is seated on the holder 50 and is secured to it for sliding displacement by means of a countersunk screw 55. A shaft portion of the holder 50 engages in a stepped central bore 56 of the grip element 54, the screw 55 reaches with its inner end close to a part 58 of the holder 50 which has a smaller diameter and is located between a shoulder 60 of the holder 50 facing the housing 52 and a collar 62 provided on this shoulder. Due to this construction the grip element 54, the central bore 56 of which is longer than the shaft of the holder 50, can be moved relative to this shaft and starting from the mid-position shown in FIG. 3 either inwards, to the right, or outwards, to the left, until the inner end of the screw 55 abuts on the shoulder 60 or on the collar 62. It is to be noted that the screw 55 also penetrates through a sleeve 64 disposed in the bore 56 of the grip element 54. The movement a of the grip element 54 to either side is schematically indicated in FIG. 3.

A bracket 66 is secured, for example by welding, to the inner end of the sleeve 64. The bracket 66 is provided with an elongated hole 68 in which a coupling pin 70 engages, this pin being fixed to a toothed rack 72 mounted on the housing 52 for sliding displacement. The toothed rack 72 is provided with a groove 74, into which the switching arm 76 of a microswitch 78 can slide when the grip element 54 is moved into its neutral or mid-position shown in FIG. 3. When the switch arm 76, or a sensing roller provided on it, lies in the groove 74, as shown in FIG. 3, the microswitch 78, which is designed as an on/off switch, is then open.

In the case of the guide handle 48 shown in FIG. 3 a biased pressure spring 82 is disposed between two discs 80 between the outer end of the sleeve 64 and a shoulder of the central bore 56 of the grip element 54. In addition, a pin 84 is provided in the holder 50 on a level with the shoulder of the central bore 56. The ends of this pin project outwards beyond the circumference of the shaft. If, with this construction, a force F, indicated by the arrow, is exerted on the grip element 54 and directed radially inwards relative to the housing 52 in the direction of the longitudinal axis of the holder 50, the spring 82 will be compressed between the disc 80 abutting on the shoulder 57 of the grip element 54 and the disc 80 abutting on the collar 62. The toothed rack 72 will then be displaced inwards—to the right in FIG. 3—and the microswitch 78 closed since its scanner 76 will be pushed out of the groove 74. When the grip element 54 is released it will return to its normal position. When the force on the grip element 54 is directed outwards in the opposite direction to force F, the outer disc 80 will abut on the pin 84 of the holder 50 while the inner disc 80 is also displaced outwards by the inner end of the sleeve 64 so that the pressure spring 82 is again compressed and can return the grip element 54 to its original position once the handle has been released.

According to the invention a second angular position detector 86 is also mounted on the housing 52 of the cutter blade mechanism 12 and has a pinion 88 seated on its shaft, which meshes with the toothed rack 72. In the case of this embodiment an inward displacement of the grip element 54 will cause the pinion 88 to rotate and result in rotation of the shaft of the second angular position detector 86 in a counter-clockwise direction. When the grip element 54 is pulled outwards this causes the shaft of the second angular position detector 86 to rotate in a clockwise direction. In the case of the cutter blade mechanism 12 shown in FIG. 3, the pressure exerted on the guide handle 48 or rather the grip element 54 will result in the microswitch 78 closing to release the drive means and, secondly, a signal being generated with the aid of the second angular position detector 86, this signal being proportional to the force F exerted on the handle 48. This signal has a predetermined magnitude and phase in accordance with the usual construction of angular position detectors, in particular linear angular position detectors. The output signal from the second angular position detector 86 serves as input signal for an X/Y position detector 87 which converts the angle of rotation of the cutter blade mechanism 12, relative to the mounting 22, into two signals which are displaced in phase relative to each other and correspond to the X component or the Y component of a feed movement in the case of the relevant angular starting position of the cutter blade mechanism 12.

The control of the inventive cutting machine will now be described in more detail on the basis of FIG. 4 of the drawings.

As shown in FIG. 4 the cutter blade motor 46 is a three-phase motor connected via a three-pole switch 90, which is actuatable by hand and can be provided on the housing 52 or also on the mounting 22 (not illustrated), to the three phase conductors of a three-phase mains. A main switch (not illustrated) is generally provided, with the aid of which the internal three-phase power supply can be completely disconnected from the main power supply. The three phase conductors are designated in the customary way with the letters R, S and T and the centerpoint conductor, which is drawn in as a dash-dot line, is designated with the reference Mp.

One of the phase conductors—phase conductor R, which has, relative to a reference voltage level, an alternating voltage of 220 V—is also connected via a switch 92 to the inputs to a generator 94 and a comparator 96. The generator 94 produces from the mains supply, which usually has a frequency of 50 Hz, an alternating voltage with a considerably higher frequency of, for example, 400 Hz, which is applied to one winding of the second angular position detector 86 via two outputs from the generator 94. The two connections to the secondary winding of the second angular position detector 86 are connected to the two connections of a primary winding of the X/Y position detector 87. The two other windings of the first angular position detector 87 are each connected via a pair of conductors to a pair of inputs to a frequency discriminator 98, the input side of which also has the 400 Hz voltage from the generator 94 fed to it as a reference signal. The frequency discriminator 98 is provided with two outputs, at which nominal value signals are available, which correspond to the required movement of the cutter blade mechanism 12 in the X direction and the Y direction. These signals are fed on the one hand to the comparator 96 and on the other to the regulator 100. The regulator 100, the input side of which is also supplied with two signals corresponding to the differences, as ascertained in the comparator 96, between the pairs of nominal and actual values to be compared, has two outputs, via which the armature current is fed to the two traction motors 30, 40, the field windings of which are supplied with predetermined currents. The supply is obtained from a power supply or rectifier unit **96*a* which is part of the comparator 96. This rectifier unit 96*a* also supplies, via a switch 102, two electromagnetic couplings 104, 106 inserted in the drive connection between the motors 30 and 40 on the bridge 14 or with the cross slide 16. The two motors 30 and 40 are each connected to a tacho-generator 30*a* or 40*a* or the like, via which the required actual value information is supplied to two corresponding inputs of the comparator 96**.

When operating the inventive cutting machine the operator first pivots the cutter blade mechanism 12 by means of its guide handle 48 into the required angular position, i.e. normally in the direction, in which the cutting edge 108 of the cutter blade 110, which lies diametrally opposite the handle 48, is pointing and in which a cut is to be made into the flat material. When the cutter blade mechanism 12 is aligned at the correct angle and, in addition, the cutter blade motor 46 is switched on the operator pushes the handle 48 or the grip element 54 in the direction of cutting so that the grip element 54 is moved towards the housing 52, whereby the microswitch 78 is switched on and the second angular position detector 86 is caused to rotate as a function of the magnitude of the force exerted. The output signal of the second angular position detector 86 thus generated is dependent on the angle of rotation in its amplitude and the direction of rotation in its phase. This signal serves as an input signal for the X/Y position detector 87; two signals associated with the X and Y directions are then generated at the two other windings of this position detector 87 as a function of the angular position of the cutter blade mechanism 12, two nominal value signals being derived from the amplitude and phase of these signals relative to the 400 Hz signal produced by the generator 94. It is thereby to be noted that the angle information is transmitted to the first angular position detector 87 on the basis of a mechanical connection between the detector and the cutter blade mechanism 12 or its motor 46, as indicated in FIG. 4 by the dotted line between the elements 46 and 87. The nominal value signals from the output of the discriminator 98 are compared in the comparator 96 with the actual value signals from the tacho-generators **30*a* and 40*a* in order to generate differential signals which are then fed to the regulator 100. The regulator will then produce corresponding armature currents for the traction motors 30, 40 as a function of the nominal value signals and differential signals so that the cutter blade mechanism 12 is driven in the desired direction; the rate of travel can thereby be preset very sensitively by the operating personnel by pushing against the grip element 54 with greater or lesser force. In this way it is possible to make straight or only slightly curved cuts at high speed and to reduce the speed at critical points, as for example for sharp corners, such that the cut can be made with the required precision and without any undesired twisting of the layers of flat material to be cut. In addition, the operator can reverse the direction of drive at any time by pulling on the grip element 54 in order to guide the cutter blade mechanism 12 back along a cut already made and start a new cut at the desired point. In this case as well the follow-up control described will have the effect that the operating personnel need only exert slight pressure on the guide handle 48 while the main force required for displacing the cutter blade mechanism 12 will be provided by the traction motors 30, 40**.

The construction of the control, which has been enlarged upon in the foregoing on the basis of the block diagram according to FIG. 4, will now be explained in more detail on the basis of FIGS. 5 to 7.

FIG. 5 again shows the cutter blade motor 46 and the first angular position detector 87 mechanically coupled with it. The switch 90, via which the motor 46 is connected to the three-phase mains, is designed as an interlockable switch, with which an under-voltage release 111 is associated. This release prevents the cutting tool being unexpectedly started when voltage returns following a loss of voltage. In addition, a further overload protection switch 112 is placed behind the switch 90. Connections to the three-phase mains result via a terminal strip 114, which also has seven connections for the first angular position detector 87 and for the microswitch 78 as well as for a further electrical line (for example reference voltage level). The arrangement of the first angular position detector 87 and the microswitch 78 is indicated as a block 116.

FIG. 5 also shows in detail that the required voltage of 220 V with respect to earth is obtained with the aid of a transformer 118, the primary side of which is located between the phase conductors R and S and the secondary side of which is earthed with the connections U and V according to valid regulations. Two safety fuses are provided on the primary side of the transformer 118, which is also the case on the primary sides of the additional transformers to be mentioned in the following. A corresponding safety fuse is inserted into connection U. The primary winding of a first transformer 120 is located between the connections U and V; the secondary winding of this transformer has two connections 1', 2', at which an alternating voltage of 24 V is present. This voltage is fed to the comparator 96 which is shown in FIG. 6, in which connections 1' and 2' are also shown again. This system of designating the connections in FIGS. 5 to 7 will be maintained in the following.

The primary side of a second transformer 122 is also connected to the connections U and V. This transformer has a tapped secondary winding with connections 3', 4', 5'. Two voltages, each of 15 V, are present between these connections, which are connected to the generator 94. Two further connections 6', 7' are directly connected to the connections U, V via associated safety fuses. An alternating voltage of 220 V is fed to the units 98, 100 and 96 via the connections 6', 7'. The primary side of a further transformer 124 is connected to the connections U and V via fuses and its secondary side to a rectifier bridge 126 via a further fuse. The transformer 124 and the bridge 126 correspond to the rectifier unit 96*a* of the comparator 96 in FIG. 4. The direct current output of the bridge 126 is connected to four parallel branches, the first of which contains the series arrangment of a switch 128 for switching on the couplings 104 and 106 as well as a relay 130, which has normally-open contacts 130.1 and 130.2 in the second and third parallel branches. The second parallel branch contains in series the operating contact 130.1, the microswitch 78 and a relay 132, which has a normally-open contact 132.1 in the third parallel branch.

The third parallel branch contains in series to the normally-open contact 130.2 and the normally-open contact 132.1 a switch 134 and a further relay 136, which has two normally-open contacts 136.1 and 136.2 as well as two normally-closed contacts 136.3 and 136.4 in the armature circuits of the traction motors 30, 40 (FIG. 7). Finally, a lamp 138 is provided in the fourth parallel branch, this lamp indicating that the main switch (not illustrated) is switched on.

The relay 130 has the effect that the motors 30, 40 cannot be switched on via the microswitch 78 until the couplings are switched on. The relay 132 has the effect that the circuit for the armature current is switched on when the motors 30, 40 are switched on and that the armature is immediately shorted when the motors 30, 40 are switched off in order to achieve a fast braking, the armature circuits (FIG. 7) each comprising a potentiometer 140, at which the required ohmic resistance for the short-circuit section can be set. Bimetallic switches 142 are also contained in the armature circuits, these switches opening when an excess temperature is reached.

FIG. 6 shows the generator 94, comparator 96, discriminator 98 and regulator 100 with their connections. These four switching networks are mostly integrated circuits which are obtainable in the trade and are manufactured, for example, by the company Messer Griesheim, Germany. The generator 94 has the model H 100, the discriminator 97 the model H 200, the comparator 96 (without the rectifier unit 96*a*) the model H 511 and the regulator 100 the model H 404.

The input side of the generator 94 is connected to the connections 3', 4' and 5', a voltage of 15 V being present between these connections. The output side of the generator 94 supplies to two connections 8' and 9' an alternating voltage having a frequency of 400 Hz and an amplitude of 26 V. This voltage is fed to the input side of the second angular position detector 86. In addition, the generator 94 supplies a reference signal to the discriminator 98 via two connecting lines 144, 146. This signal corresponds to the phase of the signal between the connections 8' and 9'. The discriminator 98 has four additional connections 24' to 27' on its input side, which are connected to the four output lines of the X/Y position detector 87. The input connections 28' and 29' of the first angular position detector 87 are directly connected to the two output connections of the second angular position detector 86, on the secondary side of which a potentiometer is provided for adjustment of the amplitude of its output signal, which determines finally the maximum rotational speed of the traction motors. Signals corresponding to the nominal values of X and Y are transmitted to the comparator via two output lines 150, 152 from the discriminator 98. The discriminator 98 is supplied via connection 6' with an alternating voltage of 220 V with respect to earth. Two additional connections 15', 16' from the minus side of the tacho-generators 30*a* and 40*a* (FIG. 7) are each connected to an input to the discriminator 98 and to the regulator 100. Finally, the discriminator 98 and regulator 100 are interconnected via four lines 154 to 160, via which signals obtained from the signals on lines 24' to 27' by half-wave rectification are supplied to the regulator.

The regulator 100, like the comparator 96, is connected to two connections 12', 13' which form one connection of the armature circuits for the traction motors 30, 40. The second connection 10' or 11' of these armature circuits is directly connected to the earthed connection 6'. Furthermore, two connecting lines 162, 164 are provided between the comparator 96 and the regulator 100 and transmit signals corresponding to the established difference between the nominal and actual values. The comparator 96 is also connected to connection 7' so that the comparator 96, which has its own earth connection 166, is supplied with an alternating voltage of 220 V. In addition, the comparator 96 is connected to two connections 14' and 17' which represent the positive connections of the tacho-generators 30*a* and 40*a*. The two voltages present at the tacho-generators 30*a* and 40*a* are therefore fed to the generator 96 via the connections 14' to 17'. The comparator 96 is also connected to connections 1' and 2', via which an alternating voltage of 24 V is fed to the comparator from the secondary side of the transformer 120 (FIG. 5). Four additional outputs of the comparator 96 are connected to connections 18' to 21'. According to FIG. 7 the exciting windings of the couplings 104 and 106 are located between the connections 18' and 19' and a direct voltage of 196 V is available between the connections 20' and 21' for the field windings 30*b* and 40*b* of the motors 30 and 40.

Also, a connecting line 168 is provided, which is connected to connections from both the discriminator 98 and the regulator 100 and to two connections for the comparator 96. An alternating voltage of 220 V is applied to this connecting line.

The numbers inserted in the blocks for the generator 94, comparator 96, discriminator 98 and regulator 100 at the various connections correspond in the embodiment to the connections of the components H 100, H 511, H 200 and H 404 from the Messer Griessheim company which are numbered in this way.

Figure 8:
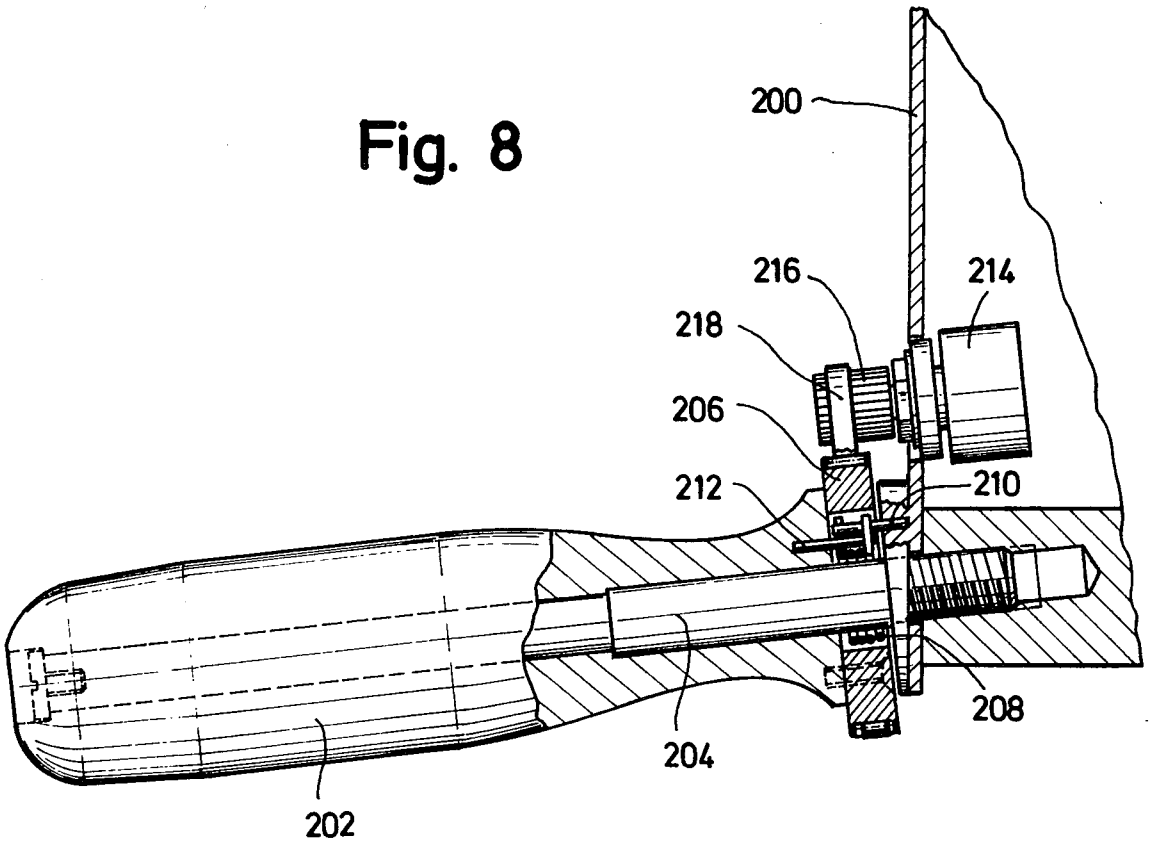

In the case of the embodiment according to FIG. 8 a guide handle 202 is mounted on the housing 200 of the cutter blade mechanism, the handle being rotatable about its longitudinal axis 204. A toothed disc 206 is secured to the handle, the inside of the toothed disc accommodating a return spring 208 designed as a coil spring, which abuts with one end on a pin 210 secured to the housing 200 and with its other end on a pin 212 secured to the guide handle 202 and attempts to hold the guide handle in a zero or neutral position. The guide handle can be rotated out of this zero position to either side contrary to the action of the return spring 208, for example through 45° in each direction, until stops, which are not illustrated, prevent any further rotation of the guide handle.

An electric potentiometer 214 is mounted within the housing 200 and a pinion 216 is secured to its shaft, which projects out of the housing 200. A toothed belt 218 runs over the pinion and the toothed disc 206.

In the embodiment according to FIG. 8 the potentiometer 214 replaces the second angular position detector 86 of the embodiment according to FIG. 3 while an equivalent to the microswitch 78 of the embodiment in FIG. 3 is not shown in the variation of FIG. 8. It is, however, obvious that such a microswitch can be provided without difficulty in order to scan the zero or neutral position of the handle 202 designed as a rotary handle.

In the zero or neutral position of the guide handle 202 the cutter blade mechanism remains stationary whereas it will move forwards at an ever increasing speed when the handle 202 is rotated about its longitudinal axis, for example, in the clockwise direction and will move backwards at an ever increasing speed when the handle is rotated in the counterclockwise direction, the speed thereby being proportional to the angle of rotation of the guide handle away from its zero position.

Figure 9:
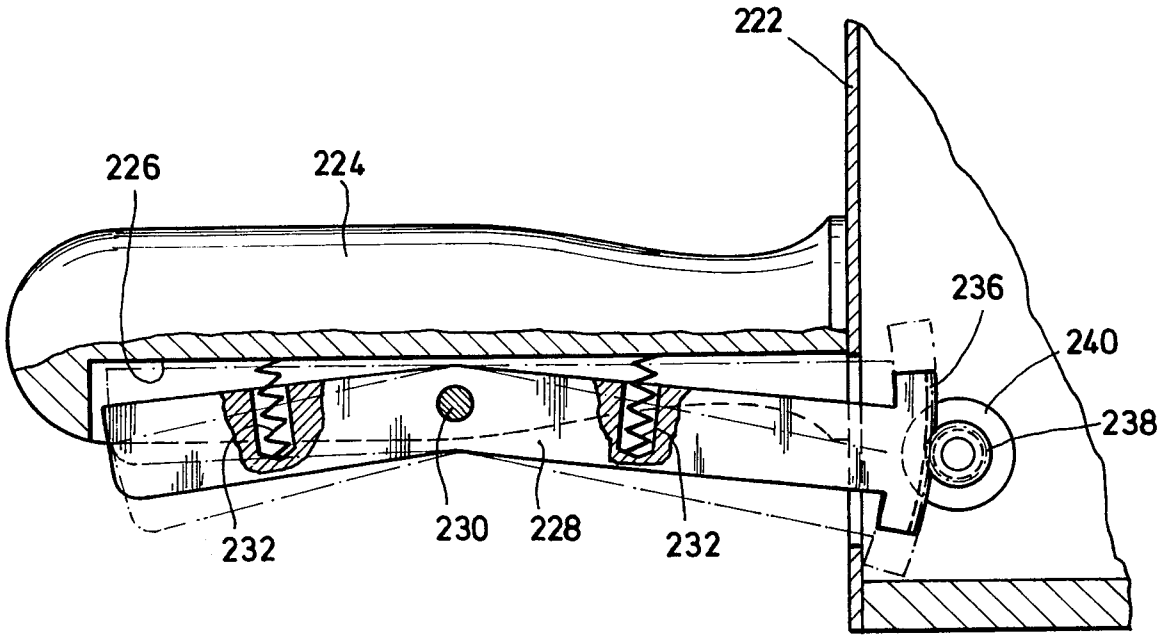

The embodiment according to FIG. 9 shows a guide handle 224 which is fixed to the housing 222 of the cutter blade mechanism and has, underneath, a groove-like recess 226. A double-arm rocker key 228 is pivotally mounted in this recess about a spindle 230 secured on the guide handle. The two arms of the rocker key are subject to the action of spring 232, which attempts to hold the rocker key in its zero or neutral position indicated by solid lines. A curved toothed rack 236 is attached to the left-hand end of the rocker key, which extends into the housing 222, and meshes with a pinion 238 on the spindle of a potentiometer 240, which is mounted in the interior of the housing 222 and corresponds in its function to the potentiometer 214 of the embodiment according to FIG. 8. In the zero or neutral position of the rocker key 228 the cutter blade mechanism remains stationary. If, for example, the left arm (according to FIG. 9) of the rocker key 228 is pressed, i.e. the rocker key pivoted in a clockwise direction, the cutter blade mechanism moves forwards; if the right arm of the rocker key is pressed, i.e. the key pivoted in a counterclockwise direction, the cutter blade mechanism moves backwards, its speed thereby corresponding to the angle by which the rocker key is pivoted out of its neutral position.

Figure 10:
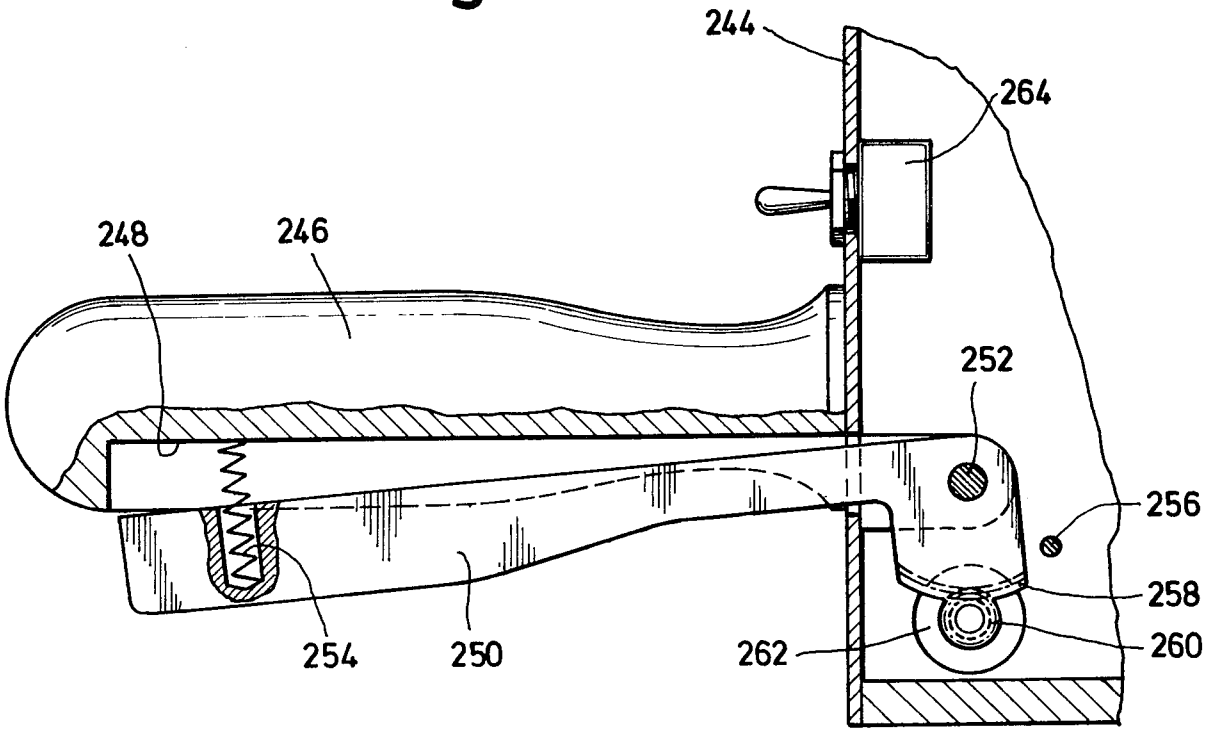

In the embodiment according to FIG. 10 a guide handle 246 is again fixed to a housing 244 of the cutter blade mechanism. The handle again has, on its underside, a groove-like recess 248, in which a control key 250 is accommodated. This penetrates into the housing 244 via a slot and is pivoted on a spindle 252 in the interior of the housing. It is subject to the action of a spring 254 which attempts to press the control key 250 against a stop 256 disposed in the housing 244, this stop defining the zero position of the control key 250. A toothed wheel segment 258 is molded onto the latter and meshes with a pinion 260 on the spindle of a potentiometer 262. In addition, an electric change-over switch 264 is attached to the wall of the housing 244 in the region of the guide handle 246 so that the drive for the cutter blade mechanism can be switched over from "forward movement" to "backward movement" while the potentiometer 262 of this embodiment merely controls the absolute value of the speed, which becomes faster the more the control key 250 is pivoted, against the action of the spring 254, out of its zero position in the counterclockwise direction.

Figure 11:
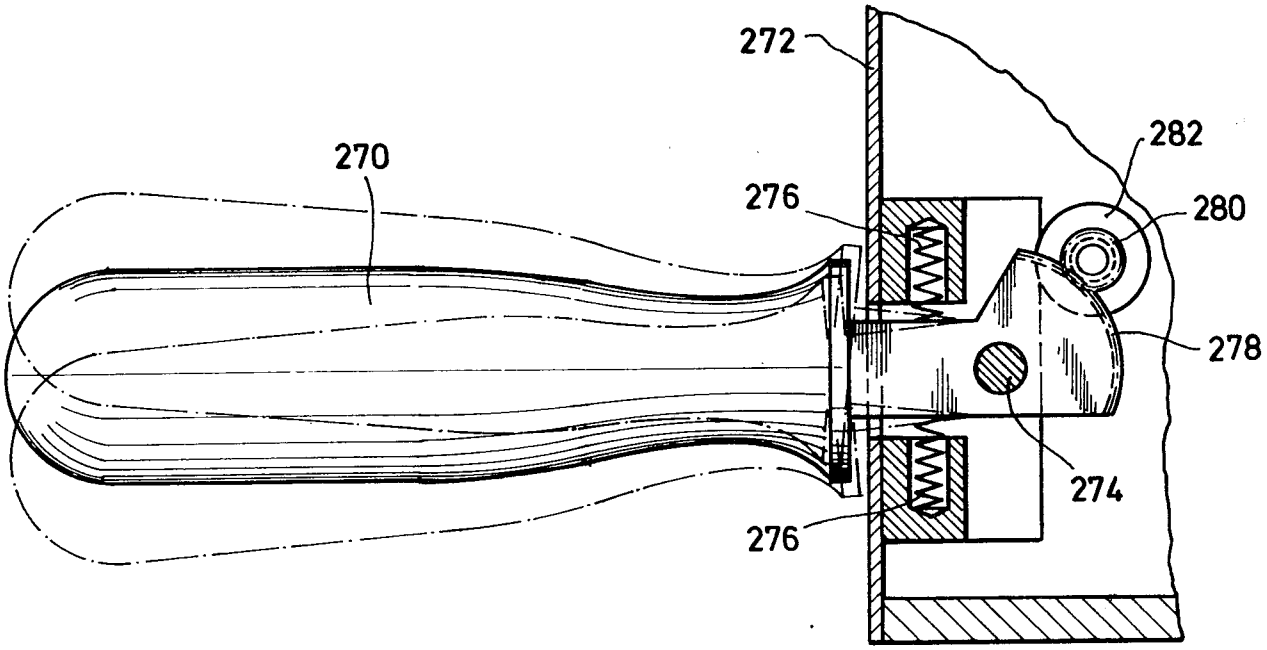

Finally, FIG. 11 shows an embodiment, with which all the control functions are again united in the guide handle. With this embodiment a guide handle designated as a whole as 270 passes through a slit in a housing 272 of the cutter blade mechanism and is pivotally mounted by means of a spindle 274 which is fixed in the interior of the housing. The guide handle is subject to the action of two springs 276 which attempt to hold the guide handle in the neutral position illustrated in FIG. 11 by solid lines.

The right-hand end (according to FIG. 11) of the guide handle 270 forms a toothed wheel segment 278 which meshes with a pinion 280 on the spindle of a potentiometer 282. The function of this embodiment corresponds to that according to FIG. 8, the only difference being that the guide handle is pivoted instead of being rotated, i.e. in the zero or neutral position of the guide handle 270 the cutter blade mechanism remains stationary but if the handle is pressed downwards, i.e. pivoted in a counterclockwise direction about the spindle 274, the cutter blade mechanism moves forwards and if the handle is raised the cutter blade mechanism moves backwards, the absolute value of its speed thereby corresponding to the angle of deflection of the handle out of its zero or neutral position.

I claim:

1. A machine for cutting out flat material, in particular a fabric cutting machine, comprising a table for bearing the flat material, a supporting structure movable along the bearing table and supporting a cutting tool, in particular a cutter blade mechanism, rotatable about an axis extending perpendicular to the bearing surface of the table, and having an associated cutting tool drive, and comprising drive means consisting of a longitudinal drive for displacing the supporting structure along the table as well as at least one additional, controllable drive associated with the supporting structure for controlling movement of the cutting tool relative to the bearing surface of the table in a direction of cutting predetermined by the orientation of a cutting edge of the cutting tool, characterized in that a first angular position detector (87) is associated with the cutting tool (12), that with the aid of said first angular position detector directional control signals corresponding to the angular position of the cutting tool (12) relative to its axis of rotation (A) are generated, that a guide handle (48) is provided on the cutting tool (12) for rotating the cutting tool (12) by hand into the desired angular position relative to its axis of rotation (A), that signal generating means are associated with the guide handle (48), with which at least one control signal is generated when the handle is acted upon and said control signal serves as a start signal for the drive means (30, 40), and that a control (FIGS. 4 to 7) is provided, with which drive control signals are generated for the drive means (30, 40) to drive the cutting tool (12) in the direction of cutting as a function of the directional control signals from the first angular position detector (87) and said at least one control signal from the signal generating means (78, 86) associated with the guide handle (48).

2. Cutting machine according to claim 1, characterized in that the signal generating means (78, 86) are designed such that at least one control signal is generated when a force acting in a predetermined direction is exerted on the guide handle (48).

3. Cutting machine according to claim 1 comprising a bridge displaceable by the longitudinal drive and spanning the bearing table in a transverse direction and also comprising a cross slide mounted on the bridge, displaceable relative to the bridge by a cross drive and supporting the cutting tool, characterized in that X/Y coordinate control signals are generated by the first angular position detector (87) for the longitudinal drive (30) and the cross drive (40).

4. Cutting machine according to claim 2 characterized in that the signal generating means (78, 86) associated with the guide handle (48) are designed such that, with their aid and when a force deviating from the predetermined direction is exerted on the guide handle (48), the cutting tool (12) is caused to return in a direction opposite to the direction of cutting of the cutting tool (12) via the control (FIGS. 4 to 7).

5. Cutting machine according to claim 4, characterized in that the signal generating means (78, 86) associated with the guide handle (48) are designed such that when a pushing force is exerted on the guide handle (48) in the direction of cutting the cutting tool (12) is driven in the direction of cutting and when a pulling force is exerted on the guide handle (48) in the opoosite direction the cutting tool (12) is driven in the reverse direction.

6. Cutting machine according to any of claim 1, characterized in that the signal generating means (78, 86) associated with the guide handle are designed such that with their aid a signal is generated as a function of the extent of displacement by hand of at least one grip element (54) of the guide handle (48) away from a predetermined zero position, and that the control (FIGS. 4 to 7) is designed such that the drive speed for the cutting tool (12) is variable as a function of the magnitude of the output signal from the signal generating means (78, 86).

7. Cutting machine according to claim 6, characterized in that at least the grip element (54) of the guide handle (48) is resiliently biased into its zero position, and that the signal generating means (78, 86) associated with the guide handle (48) are designed such that with their aid a signal is generated as a function of the magnitude of the force exerted on the guide handle (48).

8. Cutting machine according to claim 6, characterized in that the correlation between the value of the signal generated by the signal generating means (78, 86) and the drive speed for the cutting tool (12) is independent of the direction of displacement.

9. Cutting machine according to any of claim 6, characterized in that the signal generating means (78, 86) associated with the guide handle (48) comprise a second angular position detector (86), with which a drive connection (66 to 72) to a movable grip element (54) of the guide handle (48) is associated and with the aid of which an output signal is generated, which is displaced in phase relative to an input signal as a function of the extent and direction of displacement of the grip element (54) on the basis of the force exerted on the guide handle (48), this output signal being of a corresponding amplitude and serving as an input signal for the first angular position detector (87).

10. Cutting machine according to any of claim 6, characterized in that the grip element (54) of the guide handle (48) is designed as a grip element resiliently biased into a zero position and axially displaceable relative to a shaft element (50) of the guide handle (48).

11. Cutting machine according to claim 10, characterized in that the drive connection between the movable grip element (54) and the second angular position detector (86) comprises a toothed rack (72) connected to the grip element (54) and a pinion (88) seated on the shaft of the second angular position detector (86) and meshing with the toothed rack.

12. Cutting machine according to any of claim 1, characterized in that the signal generating means associated with the guide handle (48) have an on/off switch (78), with which couplings (104, 106) associated with the drive means (40 to 44) are switched on and off, respectively.

13. Cutting machine according to claim 12, characterized in that a brake means is provided, with which the cutting tool (12) is securable in its angular position relative to its axis of rotation and that a separate on/off switch, in particular in the region of the handle, is associated with the brake means.

14. Cutting machine according to any of claim 6, characterized in that the control has a generator (94) for generating an A.C. signal, the frequency of which is clearly higher than the mains frequency, that the alternating voltage generated by the generator (94) is fed to the input to the second angular position detector (86) as an input signal, that the control has a frequency discriminator (98), to which an input signal is fed as a reference signal, said input signal corresponding to the phase of the alternating voltage generated by the generator (94), and to the input side of which the output signals from the X/Y position detector (87) are fed, said output signals being displaced in phase and, in their amplitude, dependent on the force exerted on the guide handle (48) and that the X/Y output signals from the frequency discriminator (98) are fed to the input sides of a comparator (96) and a regulator (100) as X or Y nominal value signals, the output signals from the regulator (100) being fed to the armature circuits of the traction motors (30, 40), which are each connected to a tacho-generator (30*a* or 40*a*), and the output signals from the tacho-generators (30*a* and 40*a*) being fed to the comparator (96) as X or Y actual value signals.

15. Cutting machine according to claim 14, characterized in that the comparator (96) comprises a rectifier unit (96*a*).

* * * * *